US010683606B2

(12) United States Patent
Hartert

(10) Patent No.: US 10,683,606 B2
(45) Date of Patent: Jun. 16, 2020

(54) TEXTILE FABRIC HAVING A WATER-REPELLENT FINISH AND METHOD FOR PRODUCING THE SAME

(71) Applicant: TEIJIN ARAMID GMBH, Wuppertal (DE)

(72) Inventor: Rüdiger Hartert, Wuppertal (DE)

(73) Assignee: TEIJIN ARAMID GMBH, Wuppertal (DE)

( * ) Notice: Subject to any disclaimer, the term of this patent is extended or adjusted under 35 U.S.C. 154(b) by 264 days.

(21) Appl. No.: 15/157,895

(22) Filed: May 18, 2016

(65) Prior Publication Data

US 2016/0340825 A1 Nov. 24, 2016

(30) Foreign Application Priority Data

May 18, 2015 (EP) ..... 15167957

(51) Int. Cl.

| | |
|---|---|
| ***D06M 13/02*** | (2006.01) |
| ***D06M 13/224*** | (2006.01) |
| ***D06M 13/328*** | (2006.01) |
| ***D06M 15/423*** | (2006.01) |
| ***D06M 101/36*** | (2006.01) |

(52) U.S. Cl.

CPC ..... *D06M 13/02* (2013.01); *D06M 13/224* (2013.01); *D06M 13/328* (2013.01); *D06M 15/423* (2013.01); *D06M 2101/36* (2013.01); *D06M 2200/12* (2013.01)

(58) Field of Classification Search

CPC .. D06M 13/02; D06M 13/224; D06M 13/328; D06M 15/423; D06M 2101/36; D06M 2200/12; Y10T 442/2164; Y10T 442/2172; Y10T 442/218; Y10T 442/2205; Y10T 442/2197; Y10T 442/2189; Y10T 442/2262; Y10T 442/227

See application file for complete search history.

(56) References Cited

U.S. PATENT DOCUMENTS

| | | | | | |
|---|---|---|---|---|---|
| 2,402,351 | A * | 6/1946 | Smith | D06M 13/188 | 106/154.11 |
| 2,759,851 | A * | 8/1956 | Fluck | D06M 13/02 | 106/18.29 |
| 2,835,639 | A | 5/1958 | Widmer et al. | | |
| 2,923,698 | A * | 2/1960 | Rust | D06M 15/423 | 427/381 |
| 2,927,090 | A | 3/1960 | Hiestand et al. | | |
| 2,971,929 | A * | 2/1961 | Glade | D06M 15/433 | 427/393.3 |
| 3,480,579 | A | 11/1969 | Raynolds et al. | | |
| 3,660,303 | A * | 5/1972 | Hiestand | D06M 15/427 | 516/41 |
| 5,164,252 | A * | 11/1992 | Henning | D06M 15/277 | 252/8.62 |
| 5,389,136 | A * | 2/1995 | Danner | C08L 91/08 | 106/271 |
| 2005/0106967 | A1* | 5/2005 | Suzuki | B32B 27/12 | 442/86 |
| 2006/0258558 | A1* | 11/2006 | Wachter | C11D 3/2093 | 510/513 |
| 2012/0122361 | A1* | 5/2012 | Hand | D06M 13/08 | 442/79 |

FOREIGN PATENT DOCUMENTS

| | | | | |
|---|---|---|---|---|
| DE | 870 544 C | | 3/1953 | |
| DE | 1 017 133 B | | 10/1957 | |
| EP | 1396572 A1 | | 3/2004 | |
| GB | 781266 A | * | 8/1957 | C08G 12/34 |

OTHER PUBLICATIONS

European Search Report and Opinion dated Nov. 3, 2015 in European Patent Application No. 15167957.8.

* cited by examiner

*Primary Examiner* — Jennifer A Steele

(74) *Attorney, Agent, or Firm* — Oliff PLC

(57) ABSTRACT

A textile fabric of aramid fibers has a water-repellent finish, wherein the water-repellent finish includes a mixture of a component A, a component B and a component C, wherein the component A is a reaction product of an aliphatic carboxylic acid with a methylol melamine, the component B is a paraffin wax, and the component C is an ester wax C1 and/or another paraffin wax C2. The water-repellent finish preferably is free of fluorine. Additionally, a method for producing the textile fabric is described.

21 Claims, No Drawings

TEXTILE FABRIC HAVING A WATER-REPELLENT FINISH AND METHOD FOR PRODUCING THE SAME

BACKGROUND

The present application relates to a textile fabric having a water-repellent finish and to a method for producing the same.

Textile fabrics having water-repellent finishes are known.

The patent specification U.S. Pat. No. 3,480,579 describes a solid water-repellent composition comprising (a) a melamine derivative wherein all 6 H atoms of the three $NH_2$ groups are substituted by
$(CH_2OR)_x$ and $(CH_2O_2CR^1)_y$, wherein
R is a $C_1$-$C_6$ alkyl group,
$R^1$ is an aliphatic hydrocarbon group having 11-23 C atoms,
y is an integer from 2 to 5 and
x+y=6, (b) a wax, and (c) a surfactant of the formula $R^2N(R^3)_2.HO_2CR^4$, wherein
$R^2$ is a $C_{12}$-$C_{18}$ alkyl group,
$R^3$ is a $C_1$-$C_4$ alkyl group, and
$R^4CO_2H$ is a carboxylic acid having at least 1 C atom, and wherein the salt $R^2N(R^3)_2.HO_2CR^4$ contains not more than 25 C atoms.

The patent specification DE 870 544 describes a method for producing a water-repellent finish on fiber materials wherein the fiber materials are treated with solutions of derivatives of methylol amino triazines containing at least one aliphatic residue with 4 C atoms and of other hydrophobic compounds, such as paraffin, waxes such as beeswax, or fatty substances, e.g., esters of fatty acids with a higher molecular weight, such as montanic acid, in organic solvents if necessary, with addition of acidic or acid evolving catalysts, and after removing the solvent if applicable, said treated fiber material is subjected to a heat treatment, preferably at 125 to 150° C.

The term "paraffin", according to "RÖMPP CHEMIE LEXIKON", 9th ed., vol. 4 (1991), page 3216, refers to a solid, semisolid or liquid mixture of refined, saturated, aliphatic hydrocarbons. A solid paraffin wax is hard paraffin, a solid crystalline mass having a solidification point of 50-62° C. on the rotating thermometer. For semisolid paraffinic grades having a melting point of 45-65° C., designations such as soft paraffin wax are known, and for those having a melting point of 38-60° C., designations such as petroleum jelly are known. The liquid paraffin forms are often classified as mineral oils in the industrial field and together are called paraffin oil or white oil. Some paraffin fractions are treated as waxes.

The term "wax", according to "RÖMPP CHEMIE LEXIKON", 9th ed., vol. 6 (1992), page 4972, refers to substances that usually exhibit, inter alia, the following properties: kneadability at 20° C., firm to brittle hardness, coarse to fine crystallinity, and melting above 40° C. without degradation. According to "RÖMPP CHEMIE LEXIKON", 9th ed., vol. 1 (1989), page 412, beeswax is a wax obtained from the honeycombs of bees and having a melting point of 61-68° C. Beeswax consists of cerin, a mixture of cerotic acid (hexacosanic acid; $C_{25}H_{51}$—COOH; melting point=88° C.) and melissic acid (tricotanoic acid; $H_3C$—$(CH_2)_{28}$—COOH; melting point=93.4-94° C.) and of an ester blend called myricin containing about 70 esters of $C_{16}$ to $C_{36}$ acids and $C_{24}$ to $C_{36}$ alcohols.

The term "fatty substances" refers to "fats" that consist, according to "RÖMPP CHEMIE LEXIKON", 9th ed., vol. (1990), page 1339, essentially of mixed glycerol esters of higher fatty acids. Montanic acid ($H_3C$—$(CH_2)_{26}$—COOH) has a melting point of 78° C. Hence, esters of montanic acid with higher fatty acids have a melting point above 78° C.

The examined and published patent application DE 1 017 133 describes a method for making fiber materials water-repellent by i) impregnating the fiber materials in an impregnation bath, wherein the impregnation bath comprises an aqueous emulsion comprising
10 parts paraffin per 10 parts of a condensation product of a highly etherified methylol melamine methyl ether esterified with 2 moles of stearic acid and of stearic acid diglyceride, and moreover
18 parts of the acetate of the ternary basic condensation product of a highly etherified methylol melamine methyl ether, stearic acid and triethanolamine, as well as small amounts of a curing catalyst, ii) drying of the impregnated fiber materials, and iii) curing of the condensation products in a conventional manner, i.e., by a thermal treatment, e.g., at 120 to 150° C. for 5 to 15 minutes.

Especially textile fabrics of aramid fibers intended for use in ballistic applications require a water-repellent finish in order to achieve the required protective effect, expressed by the $v_{50}$ value. It is known to use finishes for this purpose that contain acrylate polymers with perfluoroalkyl groups having the structure $CF_3$—$(CF_2)_x$—$CF_2$— with x≥6.

EP 1 396 572 A1 describes a method for producing an aramid fabric having a water-repellent finish, comprising the steps of a) providing an aramid yarn, b) applying a hydrophobic agent, preferably comprising fluorine and carbon atoms, onto the aramid yarn,
wherein acrylate polymers with perfluoroalkyl groups having the structure $CF_3$—$(CF_2)_x$—$CF_2$— with x≥6 are particularly preferred, c) drying of the aramid yarn resulting from step b), d) producing a woven fabric from the aramid yarn resulting from step c) and e) thermally treating said woven fabric.

Textile fabrics of aramid fibers provided with a finish comprising fluorine and carbon atoms, such as acrylate polymers with perfluoroalkyl groups having the structure $CF_3$—$(CF_2)_x$—$CF_2$— with x≥6, show a high water-repellent effect and thus the requested ballistic protective effect. However, due to ecological reasons, customers ask more and more often for finishes on textile fabrics of aramid fibers that do not contain any fluorine.

Therefore, it is an object of the present application to provide a textile fabric of aramid fibers wherein the finish does not contain any fluorine but is at least as water-repellent as known finishes comprising acrylate polymers with perfluoroalkyl groups having the structure $CF_3$—$(CF_2)_x$—$CF_2$— with x≥6, and wherein a textile fabric of aramid fibers finished with such a water-repellent finish exhibits at least the same antiballistic effect as a textile fabric of aramid fibers finished with the known finish of acrylate polymers with the perfluoroalkyl groups having the structure $CF_3$—$(CF_2)_x$—$CF_2$— with x≥6.

SUMMARY

This object is surprisingly achieved by a textile fabric comprising aramid fibers and having a water-repellent finish, wherein the water-repellent finish comprises a mixture of a component A, a component B and a component C, wherein the component A is a reaction product of an aliphatic carboxylic acid with a methylol melamine, the component B is a paraffin wax, and the component C is an ester wax C1 and/or another paraffin wax C2.

DETAILED DESCRIPTION

Surprisingly, a textile fabric comprising aramid fibers, e.g., a woven fabric made of aramid fibers that was treated with the water-repellent finish of the present application, shows at least the same hydrophobization effect (measured as water uptake according to DIN EN 29 865 (November 1993)) and the same $v_{50}$ values under dry and wet bombardment compared to an identically constructed textile fabric comprising aramid fibers, e.g., compared to a woven fabric of aramid fibers finished with the known finish comprising acrylate polymers with perfluoroalkyl groups having the structure $CF_3$—$(CF_2)_x$—$CF_2$— with x≥6, although the water-repellent finish of the present application preferably does not contain any fluorine, i.e., preferably is fluorine-free.

Moreover, it was surprisingly found that the hydrophobization, i.e., water-repellent, effect of the textile fabric of the present application having a finish comprising a mixture of a component A, a component B and a component C, wherein the component A is a reaction product of an aliphatic carboxylic acid with a methylol melamine, the component B is a paraffin wax, and the component C is an ester wax C1 and/or another paraffin wax C2, is significantly greater than the hydrophobization effect of a textile fabric having a finish comprising either only the components A and B or only the component C.

The reasons for the synergistic increase of the hydrophobization of the textile fabric due to the co-action of a reaction product of an aliphatic carboxylic acid with a methylol melamine a paraffin wax and an ester wax C1 and/or another paraffin wax C2, are unknown even to the inventor.

Within the context of the present application, the term "aramid fibers" preferably means filament yarns that are produced from aramids, i.e., from aromatic polyamides, wherein at least 85% of the amide linkages (—CO—NH—) are attached directly to two aromatic rings. For the present application, particularly preferred aromatic polyamides are p-aramids, in particular poly-p-phenylene terephthalamide, a homopolymer resulting from the mole-for-mole polymerization of the monomers p-phenylenediamine and terephthaloyl dichloride. Therefore, in a preferred embodiment of the present application, the aramid fibers of the textile fabric of the present application are p-aramid fibers, in particular poly-p-phenylene terephthalamide fibers, and particularly preferably poly-p-phenylene terephthalamide filament yarns, which are available under the trade name TWARON® from Teijin Aramid GmbH (Germany). Moreover, aramid yarns that are suitable for the textile fabric, particularly aramid filament yarns, consist of aromatic copolymers for whose production the monomers p-phenylenediamine and/or terephthaloyl dichloride are partially or completely substituted by other aromatic diamines and/or dicarboxylic acid dichlorides.

In a preferred embodiment of the textile fabric, the textile fabric comprises, in relation to its weight, 0.8 to 4.0 wt. % dry substance, more preferably 1.4 to 3.0 wt. % dry substance and most particularly preferably 1.6 to 2.3 wt. % dry substance of the water-repellent finish. The term "dry substance" is the sum of all substances contained in the water-repellent finish that remain on and in the textile fabric after drying the textile fabric treated with the water-repellent finish to a water content of about the equilibrium moisture of the fabric under the standard atmosphere of DIN EN ISO 139/A1 (May 2008), i.e., at a temperature of 20.0±2.0° C. and at a relative humidity of 65±4.0%.

In another preferred embodiment of the textile fabric, the textile fabric is a woven fabric, a knitted fabric, or a uniaxial or multiaxial composite. If the textile fabric is a woven fabric, the term woven refers to any type of weave, such as plain weave, satin weave, panama weave, twill weave, and the like. Preferably, the woven fabric has a plain weave.

In another preferred embodiment of the textile fabric, the woven fabric, the knitted fabric, or the uniaxial or multiaxial composite comprises fibers of p-aramid.

In a particularly preferred embodiment of the textile fabric, the woven fabric, the knitted fabric, or the uniaxial or multiaxial composite consists of fibers of p-aramid, wherein said fibers in a particularly preferred embodiment are multifilament yarns that most particularly preferably consist of poly (p-phenylene terephthalamide), and in another particularly preferred embodiment are staple fiber yarns that most particularly preferably consist of poly(p-phenylene terephthalamide).

The multifilament yarns and staple fiber yarns mentioned above are available under the trade name TWARON® from Teijin Aramid GmbH, Germany.

In a preferred embodiment, the water-repellent finish consists of a mixture of the components A, B and C, wherein it is particularly preferred that none of the components mentioned above contains fluorine.

In another preferred embodiment, the water-repellent finish consists of an aqueous emulsion of the components A, B and C, wherein it is particularly preferred that none of the components mentioned above and none of the auxiliary substances, such as emulsifiers used for the preparation of the emulsion, contains fluorine.

In another preferred embodiment, the reaction product constituting the component A of the water-repellent finish is obtained by reacting an aliphatic carboxylic acid with a methylol melamine, wherein the aliphatic carboxylic acid has a structure of the formula $CH_3$—$(CH_2)_n$—COOH, wherein n is an integer in the range from 15 to 25, particularly preferably from 18 to 22, more preferably from 19 to 21 and most particularly preferably 20 (behenic acid).

Particularly preferably, reacting said aliphatic carboxylic acid with said methylol melamine consists in an esterification, so that the reaction product constituting the component A of the water-repellent finish of the textile fabric is an ester. Furthermore, it is particularly preferred that the methylol melamine is a mono-, di-, tri-, tetra-, penta-, or hexamethylol melamine.

In another particularly preferred embodiment, the reaction product constituting the component A of the water-repellent finish of the textile fabric can cross-link at an elevated temperature, e.g., in the range from about 150 to about 175° C., particularly preferred in the range from about 153 to 172° C. The cross-linking may be a cross-linking of the reaction product with itself and/or with reactive groups of fibers constituting the textile fabric and onto which said water-repellent finish was applied, and/or with other components of the water-repellent finish that might be present.

In another preferred embodiment, the paraffin wax constituting component B of the water-repellent finish has a melting point $T_B$ and the other paraffin wax of the component C has a melting point $T_{C2}$, wherein $T_{C2}$ is lower than $T_B$.

In another preferred embodiment, the melting point $T_{C2}$ of the other paraffin wax is lower by 3 to 7° C., particularly preferably lower by 4 to 6° C., and most particularly preferably lower by 5° C. than the melting point $T_B$ of the paraffin wax.

In another preferred embodiment, the paraffin wax contained in the water-repellent finish is at least one saturated hydrocarbon having a melting point $T_B$ in the range from 55 to 65° C., wherein the at least one saturated hydrocarbon preferably is at least one alkane, e.g., hexacosane ($C_{26}H_{54}$; $T_B$=56.4° C.), heptacosane ($C_{27}H_{56}$; $T_B$=59.5° C.), octacosane ($C_{28}H_{58}$; $T_B$=64.5° C.) or nonacosane ($C_{29}H_{60}$; $T_B$=63.7° C.), or a mixture of at least two of the alkanes just mentioned, and the other paraffin wax C2 contained in the water-repellent finish is at least one saturated hydrocarbon having a melting point $T_{C2}$ in the range from 50 to 60° C., wherein said at least one saturated hydrocarbon preferably is an alkane, e.g., tetracosane ($C_{24}H_{50}$; $T_{C2}$=52° C.), pentacosane ($C_{25}H_{52}$; $T_{C2}$=54° C.), hexacosane ($C_{26}H_{54}$; $T_{C2}$=56.4° C.) or heptacosane ($C_{27}H_{56}$; $T_{C2}$=59.5° C.), or a mixture of at least two of the alkanes just mentioned, however, always provided that $T_{C2}$ of the other paraffin wax C2 is lower by 3 to 7° C., preferably lower by 3 to 5° C., more preferably lower by 4 to 6° C. and particularly preferably lower by 5° C. than the melting point $T_B$ of the paraffin wax.

In a particularly preferred embodiment, the paraffin wax contained in the water-repellent finish has a melting point $T_B$ in the range from 58 to 62° C. Particularly preferably, the paraffin wax contained in the water-repellent finish has a melting point $T_B$ of about 60° C.

In another particularly preferred embodiment, the other paraffin wax C2 contained in the water-repellent finish has a melting point $T_{C2}$ in the range from 53 to 57° C. Particularly preferably, the other paraffin wax C2 contained in the water-repellent finish has a melting point $T_{C2}$ of about 55° C.

The ester wax C1 of the component C can be produced by esterification of a synthetic wax acid with a synthetic alcohol or by copolymerization of an olefin with an unsaturated ester.

In another preferred embodiment, the ester wax C1 contained in the water-repellent finish has a melting point $T_{C1}$ in the range from 50 to 60° C., particularly preferably in the range from 53 to 57° C. and most particularly preferably of about 55° C.

In another preferred embodiment, the water-repellent finish comprises the mixture of the components A, B and C, wherein the component C comprises the ester wax C1 and the other paraffin wax C2. It is particularly preferred that the finish comprises an aqueous emulsion of the components A, B and C, and particularly comprises an aqueous emulsion of the components A, B, C1, and C2.

In another preferred embodiment, the water-repellent finish comprises the components A and B in a weight percentage $w_{A+B}$ and the component C in a weight percentage $w_C$, wherein the ratio $w_{A+B}$:$w_C$ is in the range from 70:30 to 30:70, more preferably from 60:40 to 40:60, and wherein the ratio $w_{A+B}$:$w_C$ is most particularly preferably 50:50. The synergistic increase of the hydrophobization of the textile fabric described before occurs both with equal and with non-equal weight percentages $w_{A+B}$ and $w_C$. However, if non-equal weight percentages are applied, it is preferred that the ratio $w_{A+B}$:$w_C$ is in the range of 70:30 to 30:70.

In another preferred embodiment, the components A and/or B of the water-repellent finish additionally comprise at least one amine having the formula $CH_3$—$(CH_2)_m$—$N(CH_3)_2$, wherein m preferably is an integer in the range from 12 to 20, more preferably in the range from 14 to 18. For example, m is 15 (cetyldimethylamine) or 17 (dimethylstearylamine). A mixture of cetyldimethylamine and dimethylstearylamine is particularly preferred.

In another preferred embodiment, the component C of the water-repellent finish additionally contains a zirconium salt, acetic acid and isopropanol.

The textile fabric comprising aramid fibers, preferably consisting of aramid fibers, is produced by a method comprising the following steps:

a) providing a textile fabric comprising aramid fibers, preferably consisting of aramid fibers, particularly p-aramid fibers, b) finishing the textile fabric with an aqueous water-repellent finish, and c) drying the finished textile fabric, characterized in that the finish used in step b) comprises a mixture of a component A, a component B and a component C, wherein the component A is a reaction product of an aliphatic carboxylic acid with a methylol melamine, the component B is a paraffin wax, and the component C is an ester wax C1 and/or another paraffin wax C2, and the dried fabric resulting from step c) is not subjected to an additional thermal treatment.

Concerning the terms "textile fabric", "aramid fibers" and the components A, B and C, the same applies, mutatis mutandis, that already has been stated in the description of the textile fabric.

Surprisingly, it was found that the textile fabric produced by the method mentioned above, which method is also part of the present application, already has its full water-repellent effect after the drying step c).

In contrast, a textile fabric comprising aramid fibers, e.g., a woven fabric of aramid fibers, having the finish described in EP 1 396 572 A1 with acrylate polymers with perfluoroalkyl groups having the structure $CF_3$—$(CF_2)_x$—$CF_2$— with x≥6, requires an additional thermal treatment after drying. Only with this treatment are the perfluoroalkyl groups in the side chains of the polymers straightened, so that the full water-repellent effect occurs only in this straightened conformation of the perfluoroalkyl groups. The methods for producing a water-repellent finish for fiber materials described in the specification DE 870 544 and the examined and published patent application DE 1 017 133 also require an additional thermal treatment after drying the fiber materials impregnated with the finishes described therein.

When treating a textile fabric comprising aramid fibers, e.g., a woven fabric consisting of aramid fibers, with the water-repellent finish used according to the application, however, the additional thermal treatment described above is omitted, whereby the finishing of textile fabrics comprising aramid fibers, e.g., woven fabrics of aramid fibers, becomes more simple and cost-efficient.

Furthermore, during the preparation of a textile fabric comprising aramid fibers, e.g., a woven fabric consisting of aramid fibers, and before applying an water-repellent finish, the masking step that is described in Comparison example 1 of the present application and that is necessary if a textile fabric comprising aramid fibers is to be treated with a water-repellent finish comprising acrylate polymers with perfluoroalkyl groups having the structure $CF_3$—$(CF_2)_x$—$CF_2$— with x≥6 may be dispensed with. Thereby, finishing of textile fabrics comprising aramid fibers, e.g., woven fabrics consisting of aramid fibers, becomes even more simple and cost-efficient.

Concerning the preferred embodiments of the components A, B and C in the mixture used in step b) of the method, the same applies, mutatis mutandis, that has already been stated in the description of the water-repellent finish.

In order to produce the mixture used in step b) of the method, a first pre-mixture can be used comprising the components A and B. Preferably, the first pre-mixture is an aqueous emulsion, preferably comprising 20 to 30 wt. %, more preferably comprising 23 to 27 wt. %, and particularly preferably comprising 25 wt. % of A+B.

Furthermore, a second pre-mixture comprising the component C, that is, the ester wax C1 and optionally the other paraffin wax C2, can be used to produce the mixture used in step b) of the method. Preferably, the second pre-mixture is an aqueous emulsion, preferably comprising 25 to 35 wt. %, more preferably comprising 28 to 32 wt. %, and particularly preferably comprising 30 wt. % of C.

Drying of the finished textile fabric in step c) of the method is preferably performed at a drying temperature in the range from 130 to 180° C., particularly preferably in the range from 140 to 170° C., for a drying period preferably in the range from 60 to 240 seconds, particularly preferably in the range from 90 to 180 seconds.

Embodiments described herein will now be described in more detail in the following (comparison) examples:

Comparison Example 1 a) Producing an Aramid Yarn

A poly-p-phenylene terephthalamide filament yarn (TWARON®, type 2040, 930 dtex f1000 t0) is finished in the production process thereof, after washing and prior to drying, with Leomin OR (Clariant, Germany). The dried fiber contains 0.6 to 0.8 wt. % Leomin OR solids.

b) Producing a Woven Fabric

The yarn resulting from a) is processed to a woven fabric with an L (plain) 1/1 weave having 10.5 threads/cm in warp and weft and with a mass per unit area of 200 g/m$^2$.

c) Preparing the Woven Fabric for Finishing with the Water-Repellent Agent Comprising Acrylate Polymers with Perfluoroalkyl Groups Having the Structure $CF_3$—$(CF_2)_x$—$CF_2$— with x≥6

In the subsequently described steps, the woven fabric resulting from b) is pre-washed (see steps 1) to 5)), re-washed (see steps 6) to 10)), rinsed (see steps 11) to 14)), and masked and dried (see steps 15) to 24)).

1) Insertion of the woven, delivered in a roll form, into a jigger;
2) Filling the jigger with fresh water;
3) Heating the fresh water to 80° C.;
4) Pre-washing in 2 passes, wherein each pass consists of
   - $4_1$) Unrolling the woven from the roll,
   - $4_2$) Feeding the woven through the surfactant/water mixture,
   - $4_3$) Winding the woven up on an additional roll,
   - $4_4$) Unrolling the woven from the additional roll,
   - $4_5$) Feeding the woven through the surfactant/water mixture,
   - $4_6$) Winding the woven up on the roll;
5) Draining the wash water from the jigger;
6) Filling the jigger with fresh water;
7) Heating the fresh water to 80° C.;
8) Addition of the surfactant Kieralon OLB conc. (BASF) at a concentration of 1 g/l in relation to the fresh water;
9) Rewashing in 10 passes, wherein each pass consists of the above mentioned steps $4_1$ to $4_6$;
10) Draining the wash water from the jigger;
11) Filling the jigger with fresh water;
12) Heating the fresh water to 80° C.;
13) Rinsing in 3 passes, wherein each pass consists of the steps corresponding to the above mentioned steps $4_1$ to $4_6$;
14) Draining the rinse water;
15) Filling the jigger with fresh water;
16) Heating the fresh water to 80° C.;
17) Adding the masking agent Erional RF (Huntsman, Germany) at a concentration of 3 g/l in relation to the fresh water;
18) 10 masking passes, wherein each pass consists of the steps corresponding to the above mentioned steps $4_1$ to $4_6$;
19) Draining the water containing the masking agent from the jigger;
20) Filling the jigger with fresh water;
21) Heating the fresh water to 80° C.;
22) Rinsing in 4 passes, wherein each pass consists of the steps corresponding to the above mentioned steps $4_1$ to $4_6$;
23) Removal of the roll with the woven from the jigger;
24) Passing of the fabric through a drying oven at 170° C. with a residence time of the woven in the oven of approximately 60 seconds;

d) Finishing the Woven Fabric with the Water-Repellent Agent Comprising Acrylate Polymers with Perfluoroalkyl Groups Having the Structure $CF_3(CF_2)_x$—$CF_2$— with x≥6

The woven fabric resulting after step 24) of c) is fed through a bath at room temperature, which bath consists of water and, in relation to the water, 60 g/l Oleophobol SL, 30 g/l Oleophobol SM, and 10 g/l Phobol XAN (all from Huntsman, Germany). The woven fabric is subsequently squeezed, dried at 130° C. for 75 seconds, and heat treated for 95 seconds at a temperature of 190° C.

The woven fabric contains about 0.75 wt. %, in relation to its weight, of the dry substance contained in Oleophobol SL, Oleophobol SM and Phobol XAN as a water-repellent finish under equilibrium moisture in the standard atmosphere of DIN EN ISO 139/A1 (May 2008), i.e., at a temperature of 20.0±2.0° C. and at a relative humidity of 65±4.0%.

The water uptake of the finished woven measured according to DIN EN 29 865 (November 1993) is 4.5 wt. % after 10 minutes and 11.5 wt. % after 60 minutes (see table 1).

e) Antiballistic Characteristics 22 layers of the woven resulting from d) are stacked into a package. The package is bombarded using bullets of the ammunition type 9 mm DM 41, and the $v_{50}$ value is determined. The $v_{50}$ value of the package in the dry state is 474±9 m/s (see table 1).

22 further layers of the woven resulting from d) are stacked into a dry package. In order to determine the water uptake W of the dry woven fabric package, the fabric package is sewn together, allowed to stand in water for 1 hour, and drained for 3 minutes while hanging vertically. The fabric package is weighed before and after the watering and $W=(w_{before}-w_{after})/w_{before}\cdot 100\%$ is calculated, where $w_{before}$ is the weight of the fabric package before and $w_{after}$ is the weight of the fabric package after watering and draining. The water uptake before wet bombardment is 30 wt. % (see table 1).

Afterwards, the package is bombarded using bullets of the ammunition type 9 mm DM 41, and the $v_{50}$ value is determined. The $v_{50}$ value of the package in the wet state is 414±6 m/s (see table 1).

14 further layers of the woven resulting from d) are stacked into a package. The package is bombarded with fragments of the fragmentation type 1.1 g FSP, and the $v_{50}$ value is determined. The $v_{50}$ value of the package in the dry state is 483±9 m/s (see table 1).

14 further layers of the woven fabric resulting from d) are saturated with water and stacked into a package. The package is bombarded with fragments of the fragmentation type 1.1 g FSP, and the $v_{50}$ value is determined. The $v_{50}$ value of the package in the wet state is 468±11 m/s (see table 1).

Example 1 a) Producing an Aramid Yarn

A poly-p-phenylene terephthalamide filament yarn (Twaron Type 2040, 930 dtex, f1000 t0) is produced as in step a) of Comparison example 1.

b) Producing a Woven Fabric

From the aramid yarn obtained in a), a woven fabric is produced in the same way as in step b) of Comparison example 1.

c) Preparing the Woven Fabric for Finishing with an Water-Repellent Agent

In order to prepare the woven for finishing with a water-repellent agent according to the present application, the woven fabric is pre-washed (see steps 1) to 5)), re-washed (see steps 6) to 10)), rinsed (see steps 11) to 13)) as in step c) of Comparison example 1 but not masked. This means that the woven fabric is dried after step 13) as in step 24).

d) Finishing the Woven Fabric with a Water-Repellent Agent Containing a Paraffin Wax Having a Melting Point of About 60° C., the Reaction Product of Behenic Acid with a Methylol Melamine, a Paraffin Wax Having a Melting Point of About 55° C., and an Ester Wax Having a Similar Melting Point The dried woven fabric is fed through a bath at room temperature, which bath contains an aqueous mixture of equal parts of 100 g/l Repellan HY-N and 100 g/l Repellan-BD (both available from Pulcra Chemicals GmbH, Germany).

Repellan HY-N is supplied as an aqueous 25 wt. % emulsion containing a paraffin wax having a melting point of about 60° C., a reaction product of behenic acid and a methylol melamine, and additionally dimethylstearylamine and cetyldimethylamine.

Repellan BD is supplied as an aqueous 30 wt. % emulsion containing a paraffin wax having a melting point of about 55° C., an ester wax having a similar melting point, and additionally a zirconium salt, acetic acid, and isopropanol.

After leaving the bath, the woven fabric is dried at 170° C. for 120 seconds. An additional thermal treatment is not necessary and therefore does not take place.

The woven fabric contains, in relation to its weight, 1.9 wt. % of the dry substance contained in Repellan HY-N and Repellan BD as a water-repellent finish. The water uptake of the finished woven fabric measured according to DIN EN 29 865 (November 1993) is 2.6 wt. % after 10 minutes and 4.7 wt. % after 60 minutes (see table 1).

e) Antiballistic Properties 22 layers of the woven fabric treated with the water-repellent agent are stacked into a package. The package is bombarded using bullets of the ammunition type 9 mm DM 41, and the $v_{50}$ value is determined. The $v_{50}$ value of the package in the dry state is 475±4 m/s (see table 1).

22 further layers of the woven fabric treated with the water-repellent agent described in d) are stacked into a dry package. In order to determine the water uptake W of the dry woven fabric package, the fabric package is sewn together, allowed to stand in water for 1 hour, and drained for 3 minutes while hanging vertically. The fabric package is weighed before and after the watering and $W=(w_{before}-w_{after})/w_{before}\cdot 100\%$ is calculated, where $w_{before}$ is the weight of the fabric package before and $w_{after}$ is the weight of the fabric package after watering and is draining. The water uptake before wet bombardment is 15 wt. % (see table). Afterwards, the package is bombarded using bullets of the ammunition type 9 mm DM 41, and the $v_{50}$ value is determined. The $v_{50}$ value of the package in the wet state is 422±18 m/s (see table 1).

14 further layers of the woven treated with the water-repellent agent are stacked into a package. The package is bombarded with fragments of the fragmentation type 1.1 g FSP, and the $v_{50}$ value is determined.

The $v_{50}$ value of the package in the dry state is 470±8 m/s (see table 1).

14 further layers of the woven treated with the water-repellent agent are stacked into a dry package. In order to determine the water uptake W of the dry woven fabric package, the fabric package is sewn together, allowed to stand in water for 1 hour, and drained for 3 minutes while hanging vertically. The fabric package is weighed before and after the watering and $W=(w_{before}-w_{after})/w_{before}\cdot 100\%$ is calculated, where $w_{before}$ is the weight of the fabric package before and $w_{after}$ is the weight of the fabric package after watering and draining. The water uptake before wet bombardment is 15 wt. % (see table 1).

Afterwards, the package is bombarded with fragments of the fragmentation type 1.1 g FSP, and the $v_{50}$ value is determined. The $v_{50}$ value of the package in the wet state is 459±16 m/s (see table 1).

Comparison Example 2

Comparison example 2 is performed as Example 1 but with the difference that the bath in step d) is an aqueous emulsion containing 200 g/l Repellan HY-N (Pulcra Chemicals GmbH, Germany).

Comparison Example 3

Comparison example 3 is performed as Example 1 but with the difference that the bath in step d) is an aqueous emulsion containing 200 g/l Repellan BD (Pulcra Chemicals GmbH, Germany).

TABLE 1

| | Comparison example 1: Oleophobol SL + Oleophobol SM + Phobol XAN | Example 1: Repellan HY-N + Repellan BD | Comparison example 2: Repellan HY-N | Comparison example 3: Repellan BD |
|---|---|---|---|---|
| $H_2O$ uptake of the fabric after 10 min [%] | 4.5 | 2.6 | 8.5 | 4.9 |

TABLE 1-continued

| | Comparison example 1: Oleophobol SL + Oleophobol SM + Phobol XAN | Example 1: Repellan HY-N + Repellan BD | Comparison example 2: Repellan HY-N | Comparison example 3: Repellan BD |
|---|---|---|---|---|
| $H_2O$ uptake of the fabric after 60 min [%] | 11.5 | 4.7 | 10.8 | 9.6 |
| $v_{50}$ (dry) of the package with 22 woven fabrics, 9 mm DM 41 [m/s] | 474 ± 9 | 475 ± 4 | 469 ± 4 | — |
| $H_2O$ uptake of the package with 22 woven fabrics before wet bombardment [%] | 30 | 15 | 27 | — |
| $v_{50}$ (wet) of the package with 22 woven fabrics, 9 mm DM 41 [m/s] | 414 ± 6 | 422 ± 18 | 285 ± 16 | — |
| $v_{50}$ (dry) of the package with 14 woven fabrics, 1.1 g FSP [m/s] | 483 ± 9 | 470 ± 8 | 469 ± 12 | — |
| $H_2O$ uptake of the package with 14 woven fabrics before wet bombardment [%] | — | 15 | 20 | — |
| $v_{50}$ (wet) of the package with 14 woven fabrics, 1.1 g FSP [m/s] | 468 ± 11 | 459 ± 16 | 479 ± 8 | — |

The results of Example 1 and Comparison examples 1 to 3 are given in the preceding table 1. Where "$H_2O$ uptake after 10 or 60 min" is the water uptake of the finished and dry woven fabric measured after 10 or 60 min, respectively, "$v_{50}$ (dry)" is the $v_{50}$ value of the finished and dry woven fabric package, i.e., the fabric package at equilibrium moisture at a temperature of 20±2° C. and a relative humidity of 65.0±4%, "$v_{50}$ (wet)" is the $v_{50}$ value of the finished fabric package saturated with water, "9 mm DM 41" is bullet ammunition having the specification of 9 mm DM 41, "1.1 g FSP" is fragment ammunition having the specification 1.1 g FSP and "$H_2O$ uptake before wet bombardment" is the water uptake of the dry and finished fabric package before the wet bombardment.

The table 1 shows that fabrics finished with a mixture of equal parts of Repellan HY-N and Repellan BD exhibit a significantly lower water uptake than fabrics finished with the mixture of (Oleophobol SL+Oleophobol SM+Phobol XAN). When these fabrics are layered to form a package, the fabrics finished with a mixture of equal parts of Repellan HY-N and Repellan BD exhibit similar $v_{50}$ values, within the range of error of the $v_{50}$ determination, to fabric packages finished with the mixture (Oleophobol SL+Oleophobol SM+Phobol XAN).

These results are all the more surprising because the finishing of fabrics with Repellan HY-N and Repellan BD is significantly easier to perform during the preparation of the fabric to be finished due to the omission of masking as well as after drying the finished fabric due to the omission of a further thermal treatment.

The comparison of Example 1 to Comparison example 2 shows that after 10 minutes the $H_2O$ uptake of the fabric hydrophobized with the aqueous mixture of equal parts of 100 g/l Repellan HY-N and 100 g/l Repellan BD was only 2.6% and thus 8.5:2.6=3.3 times lower than with the fabric hydrophobized with an aqueous emulsion of 200 g/l Repellan HY-N.

The comparison of Example 1 to Comparison example 3 shows that after 10 minutes the $H_2O$ uptake of the fabric hydrophobized with the aqueous mixture of equal parts of 100 g/l Repellan HY-N and 100 g/l Repellan BD was only 2.6% and thus 4.9:2.6=1.9 times lower than with the fabric hydrophobized with an aqueous emulsion of 200 g/l Repellan BD.

The comparison of Example 1 to Comparison example 2 shows that after 60 minutes the $H_2O$ uptake of the fabric hydrophobized with the aqueous mixture of equal parts of 100 g/l Repellan HY-N and 100 g/l Repellan BD was only 4.7% and thus 10.8:4.7=2.3 times lower than with the fabric hydrophobized with an aqueous emulsion of 200 g/l Repellan HY-N.

The comparison of Example 1 to Comparison example 3 shows that after 60 minutes the $H_2O$ uptake of the fabric hydrophobized with the aqueous mixture of equal parts of 100 g/l Repellan HY-N and 100 g/l Repellan BD was only 4.7% and thus 9.6:4.7=2.0 times lower than with the fabric hydrophobized with an aqueous emulsion of 200 g/l Repellan BD.

Thus, the comparison of the hydrophobization achieved in Example 1 with the hydrophobization achieved in Comparison examples 2 and 3 shows that the paraffin wax contained in Repellan HY-N with a melting point of about 60° C. and the reaction product of behenic acid with a methylol melamine and the paraffin wax contained in Repellan BD with a melting point of about 55° C. and the ester wax with a similar melting point synergistically effect a degree of hydrophobization that is significantly greater than the hydrophobization achieved by the same amount of Repellan HY-N or Repellan BD alone.

The synergistic effect of said hydrophobization components is also noticeable in the greater antiballistic effect under bombardment with ammunition of the specification 9 mm DM 41: the fabric package hydrophobized with an aqueous mixture of equal parts of 100 g/l Repellan HY-N and 100 g/l Repellan BD exhibits an antiballistic effect with $v_{50}$=422±18 [m/s] that is (422:285)=1.5 times greater than the antiballistic effect of the package of fabrics hydrophobized with an aqueous emulsion of 200 g/l Repellan HY-N. Moreover, the water uptake before wet bombardment of 15% is (27:15)=1.8 times lower. Before bombardment with fragments of the specification 1.1 g FSP, the water uptake of 15% is (20:15)=1.3 times lower.

The $v_{50}$ values of the fabric packages whose fabrics were hydrophobized with an emulsion of 200 g/l Repellan BD were not measured. However, due to the fact that these fabrics have a worse hydrophobization compared to the fabrics of Example 1, it can be assumed that the $v_{50}$ values of these fabric packages are lower than 422±18 [m/s].

Example 2 a) Producing an Aramid Yarn

A poly-p-phenylene terephthalamide filament yarn (Twaron Type 2040, 930 dtex, f1000 t0) is produced as in step a) of Comparison example 1.

b) Producing a Woven Fabric

From the aramid yarn obtained in a), a woven fabric is produced in the same way as in step b) of Comparison example 1.

c) Preparing the Woven Fabric for Finishing with a Water-Repellent Agent of the Application In order to prepare the woven for finishing with a water-repellent agent of the present application, the woven fabric is pre-washed (see steps 1) to 5)), re-washed (see steps 6) to 10)), as in step c) of comparative example 1, and then—in a different way from comparative example 1—sprayed with water in 4 spraying passages but not masked. This means that the roll with the woven fabric is removed after step 13) as in step 24), and that the woven fabric is dried as in step 24.

d) Finishing the Woven Fabric with a Water-Repellent Agent Containing a Paraffin Wax Having a Melting Point of About 60° C., the Reaction Product of Behenic Acid with a Methylol Melamine, a Paraffin Wax Having a Melting Point of About 55° C., and an Ester Wax Having a Similar Melting Point The dried woven fabric is fed through a bath at room temperature, which bath contains an aqueous mixture of equal parts of 80 g/l Repellan HY-N and 80 g/l Repellan-BD (both available from Pulcra Chemicals GmbH, Germany), and which bath exhibits a pH value of 4.

The woven fabric, which after leaving the bath shows a liquor uptake of 36%, is dried at 170° C. for 120 seconds. An additional thermal treatment is not necessary and therefore does not take place.

The woven fabric contains, in relation to its weight, 1.52 wt. % of the dry substance contained in Repellan HY-N and Repellan BD as a water-repellent finish. The water uptake of the finished woven fabric after 10 minutes measured according to DIN EN 29 865 (November 1993) is 3.31 wt. %. The repel effect measured according to DIN EN 29 865 (November 1993) achieves grade 4 on a scale from 1 to 5 (see the reference photographs in picture 1 of DIN EN 29 865 (November 1993). The stiffness of the finished woven fabric was measured according to ASTM D4032-8 and amounts to 22.3 N.

Comparison Example 4

Comparison example 4 is performed as Example 2 but with the difference that the bath in step d) is an aqueous emulsion containing 160 g/l Repellan HY-N (Pulcra Chemicals GmbH, Germany).

The water uptake of the finished woven fabric after 10 minutes measured according to DIN EN 29 865 (November 1993) is 5.69 wt. %. The repel effect measured according to DIN EN 29 865 (November 1993) achieves grade 4 on a scale from 1 to 5 (see the reference photographs in picture 1 of DIN EN 29 865 (November 1993). The stiffness of the finished woven fabric was measured according to ASTM D4032-8 and amounts to 26.8 N.

Comparison Example 5

Comparison example 5 is performed as Example 2 but with the difference that the bath in step d) is an aqueous emulsion containing 160 g/l Repellan BD (Pulcra Chemicals GmbH, Germany).

The water uptake of the finished woven fabric after 10 minutes measured according to DIN EN 29 865 (November 1993) is 8.14 wt. %. The repel effect measured according to DIN EN 29 865 (November 1993) achieves grade 4-3 on a scale from 1 to 5 (see the reference photographs in picture 1 of DIN EN 29 865 (November 1993). The stiffness of the finished woven fabric was measured according to ASTM D4032-8 and amounts to 22.8 N.

The results of example 2 and comparison examples 4 and 5 are shown in table 2.

Example 3

Example 3 is performed as example 2 with the difference that in step d), the woven fabric is fed through a bath, which bath contains an aqueous mixture of equal parts of 60 g/l Repellan HY-N and 60 g/l Repellan-BD (both available from Pulcra Chemicals GmbH, Germany).

The woven fabric contains, in relation to its weight, 1.14 wt. % of the dry substance contained in Repellan HY-N and Repellan BD as a water-repellent finish. The water uptake of the finished woven fabric after 10 minutes measured according to DIN EN 29 865 (November 1993) is 3.53 wt. %. The repel effect measured according to DIN EN 29 865 (November 1993) achieves grade 4 on a scale from 1 to 5 (see the reference photographs in picture 1 of DIN EN 29 865 (November 1993). The stiffness of the finished woven fabric was measured according to ASTM D4032-8 and amounts to 22.8 N.

Comparison Example 6

Comparison example 6 is performed as Example 2 but with the difference that the bath in step d) is an aqueous emulsion containing 120 g/l Repellan HY-N (Pulcra Chemicals GmbH, Germany).

The water uptake of the finished woven fabric after 10 minutes measured according to DIN EN 29 865 (November 1993) is 6.65 wt. %. The repel effect measured according to DIN EN 29 865 (November 1993) achieves grade 4-3 on a scale from 1 to 5 (see the reference photographs in picture 1 of DIN EN 29 865 (November 1993). The stiffness of the finished woven fabric was measured according to ASTM D4032-8 and amounts to 22.4 N.

Comparison Example 7

Comparison example 7 is performed as Example 2 but with the difference that the bath in step d) is an aqueous emulsion containing 120 g/l Repellan BD (Pulcra Chemicals GmbH, Germany).

The water uptake of the finished woven fabric after 10 minutes measured according to DIN EN 29 865 (November 1993) is 10.8 wt. %. The repel effect measured according to DIN EN 29 865 (November 1993) achieves grade 4-3 on a scale from 1 to 5 (see the reference photographs in picture 1 of DIN EN 29 865 (November 1993). The stiffness of the finished woven fabric was measured according to ASTM D4032-8 and amounts to 18.5 N.

The results of example 3 and comparison examples 6 and 7 are shown in table 2.

Example 4

Example 4 is performed as example 2 with the difference, that in step d) the woven fabric is fed through a bath, which bath contains an aqueous mixture of equal parts of 40 g/l Repellan HY-N and 40 g/l Repellan-BD (both available from Pulcra Chemicals GmbH, Germany).

The woven fabric contains, in relation to its weight, 0.76 wt. % of the dry substance contained in Repellan HY-N and Repellan BD as a water-repellent finish. The water uptake of the finished woven fabric after 10 minutes measured according to DIN EN 29 865 (November 1993) is 5.70 wt. %. The repel effect measured according to DIN EN 29 865 (November 1993) achieves grade 4 on a scale from 1 to 5 (see the reference photographs in picture 1 of DIN EN 29 865 (November 1993). The stiffness of the finished woven fabric was measured according to ASTM D4032-8 and amounts to 22.1 N.

DIN EN 29 865 (November 1993) achieves grade 4-3 on a scale from 1 to 5 (see the reference photographs in picture 1 of DIN EN 29 865 (November 1993). The stiffness of the finished woven fabric was measured according to ASTM D4032-8 and amounts to 16.5 N.

The results of example 4 and comparison examples 8 and 9 are shown in table 2.

The comparison of Example 2 to Comparison example 4 shows that after 10 minutes, the $H_2O$ uptake of the fabric hydrophobized with the aqueous mixture of equal parts of 80 g/l Repellan HY-N and 80 g/l Repellan BD was only 3.31% and thus 5.69:3.31=1.7 times lower than with the fabric hydrophobized with an aqueous emulsion of 160 g/l Repellan HY-N.

The comparison of Example 2 to Comparison example 5 shows that after 10 minutes, the $H_2O$ uptake of the fabric hydrophobized with the aqueous mixture of equal parts of 80 g/l Repellan HY-N and 80 g/l Repellan BD was only 3.31% and thus 8.14:3.31=2.5 times lower than with the fabric hydrophobized with an aqueous emulsion of 160 g/l Repellan HY-N.

TABLE 2

| | Ex. 2 | Comparison ex. 4 | Comparison ex. 5 | Ex. 3 | Comparison ex. 6 | Comparison ex. 7 | Ex. 4 | Comparison ex. 8 | Comparison ex. 9 |
|---|---|---|---|---|---|---|---|---|---|
| Repellan HY-N [g/l] | 80 | 160 | 0 | 60 | 120 | 0 | 40 | 80 | 0 |
| Repellan BD [g/l] | 80 | 0 | 160 | 60 | 0 | 120 | 40 | 0 | 80 |
| $H_2O$-uptake of the fabric after 10 minutes [%] | 3.31 | 5.69 | 8.14 | 3.53 | 6.65 | 10.8 | 5.70 | 4.37 | 10.8 |
| Repel effect of the fabric | 4 | 4 | 4-3 | 4 | 4-3 | 4-3 | 4 | 4 | 4-3 |
| Stiffness of the fabric [N] | 22.3 | 26.8 | 22.8 | 22.8 | 22.4 | 18.5 | 22.1 | 19.4 | 16.5 |

Comparison Example 8

Comparison example 8 is performed as Example 2 but with the difference that the bath in step d) is an aqueous emulsion containing 80 g/l Repellan HY-N (Pulcra Chemicals GmbH, Germany).

The water uptake of the finished woven fabric after 10 minutes measured according to DIN EN 29 865 (November 1993) is 4.37 wt. %. The repel effect measured according to DIN EN 29 865 (November 1993) achieves grade 4 on a scale from 1 to 5 (see the reference photographs in picture 1 of DIN EN 29 865 (November 1993). The stiffness of the finished woven fabric was measured according to ASTM D4032-8 and amounts to 19.4 N.

Comparison Example 9

Comparison example 9 is performed as Example 2 but with the difference that the bath in step d) is an aqueous emulsion containing 80 g/l Repellan BD (Pulcra Chemicals GmbH, Germany).

The water uptake of the finished woven fabric after 10 minutes measured according to DIN EN 29 865 (November 1993) is 10.8 wt. %. The repel effect measured according to Thus, the comparison of the hydrophobization achieved in Example 2 with the hydrophobization achieved in Comparison examples 4 and 5 shows that the paraffin wax contained in Repellan HY-N with a melting point of about 60° C. and the reaction product of behenic acid with a methylol melamine and the paraffin wax contained in Repellan BD with a melting point of about 55° C. and the ester wax with a similar melting point synergistically effect a degree of hydrophobization that is significantly greater than the hydrophobization achieved by the same amount of Repellan HY-N or Repellan BD alone.

Furthermore, comparison of example 2 with comparison examples 4 and 5 reveals that the fabric which was fed through a bath containing a mixture of equal weight parts of Repellan HY-N and Repellan BD exhibits a lower stiffness than the comparative woven fabrics of comparison example 4 and 5 which were fed through a bath that contained 160 g/l Repellan HY-N and 160 g/l Repellan BD, respectively.

The comparison of Example 3 to Comparison example 6 shows that after 10 minutes, the $H_2O$ uptake of the fabric hydrophobized with the aqueous mixture of equal parts of 60 g/l Repellan HY-N and 60 g/l Repellan BD was only 3.53% and thus 5.69:3.53=1.9 times lower than with the fabric hydrophobized with an aqueous emulsion of 120 g/l Repellan HY-N.

The comparison of Example 3 to Comparison example 7 shows that after 10 minutes, the $H_2O$ uptake of the fabric hydrophobized with the aqueous mixture of equal parts of 60 g/l Repellan HY-N and 60 g/l Repellan BD was only 3.53% and thus 10.8:3.53=3.1 times lower than with the fabric hydrophobized with an aqueous emulsion of 120 g/l Repellan HY-N.

Thus, the comparison of the hydrophobization achieved in Example 3 with the hydrophobization achieved in Comparison examples 6 and 7 shows that

- the paraffin wax contained in Repellan HY-N with a melting point of about 60° C. and the reaction product of behenic acid with a methylol melamine and
- the paraffin wax contained in Repellan BD with a melting point of about 55° C. and the ester wax with a similar melting point synergistically effect a degree of hydrophobization that is significantly greater than the hydrophobization achieved by the same amount of Repellan HY-N or Repellan BD alone.

The invention claimed is:

1. Textile fabric comprising aramid fibers and having a water-repellent finish, wherein the water-repellent finish comprises a mixture of a component A, a component B and a component C, wherein

- the component A is a reaction product of components consisting of an aliphatic carboxylic acid and a methylol melamine,
- the component B is a paraffin wax,
- the component C is another paraffin wax C2 different from the component B paraffin wax, and
- the water-repellent finish does not contain any fluorine,
- wherein the water-repellent finish contains the components A and B in a weight percentage $w_{A+B}$ and the component C in a weight percentage $w_C$, wherein the ratio $w_{A+B}$:$w_C$ is in the range from 70:30 to 30:70.

2. Textile fabric according to claim 1, wherein the textile fabric comprises 0.8 to 4.0 wt. % dry substance of the water-repellent finish in relation to its weight.

3. Textile fabric according to claim 1, wherein the textile fabric is a woven fabric, a knitted fabric, or a uniaxial or multiaxial composite.

4. Textile fabric according to claim 1, wherein the aramid fibers are p-aramid fibers.

5. Textile fabric according to claim 1, wherein the reaction product of component A of the water-repellent finish is obtained by reacting an aliphatic carboxylic acid with a methylol melamine, wherein the aliphatic carboxylic acid has a structure of the formula $CH_3$—$(CH_2)_n$—COOH, wherein n is an integer in the range from 15 to 25.

6. Textile fabric according to claim 1, wherein the paraffin wax of component B of the water-repellent finish has a melting point $T_B$ and the other paraffin wax C2 of the component C has a melting point $T_{C2}$, wherein $T_{C2}$ is lower than $T_B$.

7. Textile fabric according to claim 6, wherein the melting point $T_{C2}$ of the other paraffin wax C2 contained in the water-repellent finish is lower by 3 to 7° C. than the melting point $T_B$ of the paraffin wax.

8. Textile fabric according to claim 1, wherein the paraffin wax of component B of the water-repellent finish is at least one saturated hydrocarbon having a melting point $T_B$ in the range from 55 to 65° C. and that the other paraffin wax C2 is at least one saturated hydrocarbon having a melting point $T_{C2}$ in the range from 50 to 60° C.

9. Textile fabric according to claim 1, wherein the water-repellent finish comprises an aqueous emulsion of the components A, B and C.

10. Textile fabric according to claim 1, wherein the components A and/or B additionally comprise at least one amine of the formula $CH_3$—$(CH_2)_m$—$N(CH_3)_2$, wherein m represents an integer in the range from 12 to 20.

11. Textile fabric according to claim 1, wherein the component C of the water-repellent finish additionally comprises a zirconium salt, acetic acid and isopropanol.

12. Method for producing a textile fabric comprising aramid fibers, the method comprising:

a) providing a textile fabric comprising aramid fibers, b) finishing the textile fabric with an aqueous water-repellent finish, and c) drying the finished textile fabric, wherein

- the finish used in b) is a mixture of a component A, a component B and a component C, wherein
  - the component A is a reaction product of components consisting of an aliphatic carboxylic acid and a methylol melamine,
  - the component B is a paraffin wax,
  - the component C is another paraffin wax C2 different from the component B paraffin wax, and
  - the water-repellent finish does not contain any fluorine, wherein the water-repellent finish contains the components A and B in a weight percentage $w_{A+B}$ and the component C in a weight percentage $w_C$, wherein the ratio $w_{A+B}$:$w_C$ is in the range from 70:30 to 30:70, and
- the dried fabric resulting from c) is not subjected to any thermal treatment following c).

13. Textile fabric comprising aramid fibers and having a water-repellent finish, wherein the water-repellent finish comprises a mixture of a component A, a component B and a component C, wherein

- the component A is a reaction product of components consisting of an aliphatic carboxylic acid and a methylol melamine,
- the component B is a paraffin wax,
- the component C is an ester wax C1, and
- the water-repellent finish does not contain any fluorine,
- wherein the water-repellent finish contains the components A and B in a weight percentage $w_{A+B}$ and the component C in a weight percentage $w_C$, wherein the ratio $w_{A+B}$:$w_C$ is in the range from 70:30 to 30:70.

14. Textile fabric according to claim 13, wherein the textile fabric comprises 0.8 to 4.0 wt. % dry substance of the water-repellent finish in relation to its weight.

15. Textile fabric according to claim 13, wherein the textile fabric is a woven fabric, a knitted fabric, or a uniaxial or multiaxial composite.

16. Textile fabric according to claim 13, wherein the aramid fibers are p-aramid fibers.

17. Textile fabric according to claim 13, wherein the reaction product of component A of the water-repellent finish is obtained by reacting an aliphatic carboxylic acid with a methylol melamine, wherein the aliphatic carboxylic acid has a structure of the formula $CH_3$—$(CH_2)_n$—COOH, wherein n is an integer in the range from 15 to 25.

18. Textile fabric according to claim 13, wherein the ester wax C1 contained in the water-repellent finish has a melting point $T_{C1}$ in the range from 50 to 60° C.

19. Textile fabric according to claim 13, wherein the water-repellent finish comprises an aqueous emulsion of the components A, B and C.

20. Textile fabric according to claim 13, wherein the components A and/or B additionally comprise at least one amine of the formula $CH_3$—$(CH_2)_m$—$N(CH_3)_2$, wherein m represents an integer in the range from 12 to 20.

21. Textile fabric according to claim 13, wherein the component C of the water-repellent finish additionally comprises a zirconium salt, acetic acid and isopropanol.

* * * * *